US011002279B2

(12) United States Patent
Cho et al.

(10) Patent No.: US 11,002,279 B2
(45) Date of Patent: May 11, 2021

(54) ROTARY COMPRESSOR

(71) Applicant: LG ELECTRONICS INC., Seoul (KR)

(72) Inventors: Gukhyun Cho, Seoul (KR); Sedong Lee, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 273 days.

(21) Appl. No.: 16/038,340

(22) Filed: Jul. 18, 2018

(65) Prior Publication Data

US 2019/0024658 A1 Jan. 24, 2019

(30) Foreign Application Priority Data

Jul. 24, 2017 (KR) ..... 10-2017-0093728

(51) Int. Cl.

| | |
|---|---|
| ***F04C 29/12*** | (2006.01) |
| ***F04C 2/356*** | (2006.01) |
| ***F04C 15/00*** | (2006.01) |
| ***F04C 23/00*** | (2006.01) |

(52) U.S. Cl.

CPC ..... *F04C 29/12* (2013.01); *F04C 2/3564* (2013.01); *F04C 15/0065* (2013.01); *F04C 23/001* (2013.01); *F04C 23/008* (2013.01); *F04C 2210/26* (2013.01); *F04C 2250/101* (2013.01)

(58) Field of Classification Search

CPC .... F04C 2/3564; F04C 23/001; F04C 23/008; F04C 29/12; F04C 15/0065; F04C 2250/101

See application file for complete search history.

(56) References Cited

FOREIGN PATENT DOCUMENTS

| | | | | |
|---|---|---|---|---|
| EP | 2169230 A2 * | 3/2010 | ..... | F01C 21/0845 |
| JP | 09250477 A * | 9/1997 | | |
| JP | H09250477 A | 9/1997 | | |
| KR | 10-2010-00034914 A | 4/2010 | | |
| KR | 10-2010-00060785 A | 6/2010 | | |
| KR | 10-2011-0064280 A | 6/2011 | | |
| KR | 10-2015-0081142 A | 7/2015 | | |
| KR | 10-2016-0034074 A | 3/2016 | | |

OTHER PUBLICATIONS

International Search Report, dated Oct. 16, 2018, issued in PCT/KR2018/007940(12 pages).

* cited by examiner

*Primary Examiner* — Alexander B Comley
(74) *Attorney, Agent, or Firm* — Finnegan, Henderson, Farabow, Garrett & Dunner, LLP

(57) ABSTRACT

A rotary compressor includes a cylinder with a vane slot and a suction port. A vane is slidably disposed in the vane slot. The suction port guides fluid to a compression chamber at one circumferential end of the vane slot. The suction port may be formed in a recessed manner in a radial direction such that at least an end of the suction port in contact with an inner circumferential surface of the cylinder forms a slot shape extending between opposite axial side surfaces of the cylinder. A circumferential length of the suction port is reduced from conventional suction ports as a result of the slot configuration, thereby advancing the compression start angle, and a partition wall portion between the suction port and the vane slot may have elasticity, thereby suppressing close contact between the vane and the vane slot.

7 Claims, 8 Drawing Sheets

ROTARY COMPRESSOR

CROSS-REFERENCE TO RELATED APPLICATIONS

The present disclosure relates to subject matter contained in priority Korean Application No. 10-2017-0093728, filed on Jul. 24, 2017, which is expressly incorporated herein by reference in its entirety.

BACKGROUND OF THE INVENTION

1. Field of the Invention

The present disclosure relates to a rotary compressor, and more particularly, to a suction port shape of a rotary compressor.

2. Description of the Related Art

In general, a rotary compressor is a compressor in which a roller (or a rolling piston) and a vane are brought into contact with each other in a compression space of a cylinder, and the compression space of the cylinder is divided into a suction chamber and a discharge chamber around the vane. In such a rotary compressor, the vane performs a linear motion while the roller performs an orbiting motion, and thus the suction chamber and the discharge chamber form a compression chamber having a variable volume (capacity) to suck, compress and discharge refrigerant.

Furthermore, in this rotary compressor, a recessed vane slot is formed to a predetermined depth in a radial direction on an inner circumferential surface of the cylinder, and a suction port is formed on one side in a circumferential direction with respect to the vane slot, and thus refrigerant is sucked into the suction chamber.

The shape of the suction port may be formed according to a shape of the compressor. For example, in a single rotary compressor having one cylinder, a suction port is mostly formed to pass from an outer circumferential surface to an inner circumferential surface of the cylinder. However, in a twin rotary compressor having a plurality of cylinders, the suction port may be formed to penetrate from an outer circumferential surface to an inner circumferential surface of each cylinder similarly to the single rotary compressor, but may be formed to be inclined in a groove shape on an inner circumferential edge of the cylinder or bent on a lower or upper surface of the cylinder to pass through the inner circumferential surface unlike the single rotary compressor.

In other words, as an intermediate plate is provided between the plurality of cylinders in the twin rotary compressor, one suction guide groove is formed to connect one suction pipe to the intermediate plate, and a suction groove or suction hole connected to the suction guide groove may be formed to be inclined or bent on each cylinder.

However, in a rotary compressor in the related art as described above, as an outlet end of the suction port is formed wide in a circumferential direction on an inner circumferential surface of the cylinder, a suction completion time, i.e., a compression start time, is delayed, and thus a compression period is shortened to generate over-compression, thereby deteriorating the performance of the compressor. In other words, in a rotary compressor in the related art, as the suction port is mainly formed in a substantially circular shape or at least partly formed in a curved surface, a circumferential width of the suction port must be increased to secure a required cross-sectional area of the suction port, and due to this, an interval from a start point to an end point of a suction stroke becomes longer, and as a result, the compression start time may be delayed as described above.

In addition, in a rotary compressor in the related art, a vane inserted into a vane slot is pushed out in a circumferential direction (lateral direction) by a pressure of the discharge chamber while a suction side of the vane is compressed to an inner side of the vane slot, due to this, there is a problem that the vane is excessively brought into close contact with a roller (rolling piston) while not smoothly entering and exiting the vane slot to increase motor input, or conversely the vane and the roller are separated from each other to cause refrigerant leakage.

SUMMARY OF THE INVENTION

An object of the present disclosure is to provide a rotary compressor capable of reducing a circumferential length of a suction port in comparison with the same area of the suction port to move a compression start angle in a suction start direction, that is, a vane direction.

Another object of the present disclosure is to provide a rotary compressor capable of suppressing a vane separating between a suction chamber and a discharge chamber from being excessively brought into close contact with a vane slot by a discharge pressure to suppress an input loss of a motor and suppress separation between the vane and the roller.

In order to solve the objectives of the present disclosure, there is provided a rotary compressor, including at least one or more cylinders formed in an annular shape; at least two or more plate members provided on both upper and lower sides of the cylinder to form at least one or more compression chambers together with the at least one or more cylinders; at least one or more rollers provided inside the at least one or more compression chambers, respectively, and coupled to a rotation shaft to operate; and at least one or more vanes slidably inserted into the at least one or more cylinders, respectively, and brought into contact with an outer c circumferential surface of the at least one or more rollers to divide the at least one or more compression chambers into a suction chamber and a discharge chamber, wherein the cylinder is respectively formed with a vane slot into which the vane is slidably inserted, and respectively formed with a suction port for guiding fluid to the at least one or more compression chambers at one circumferential side of the vane slot, and the suction port is formed in a recessed manner in a radial direction such that at least an end of the suction port in contact with an inner circumferential surface of the cylinder forms a slot shape.

Here, the entire suction port may be formed in a slot shape from an outer circumferential end to an inner circumferential end in contact with the inner circumferential surface of the cylinder.

In alternative embodiments, the suction port may include a non-slot portion formed to block at least one of both axial side surfaces of the cylinder; and a slot portion formed to be recessed in a slot shape by a predetermined depth from an inner circumferential surface of the cylinder and connected to the non-slot portion. In some embodiments, both inner circumferential side surfaces of the suction port may be formed to be symmetrical with respect to a radial center line.

In other embodiments, both circumferential inner side surfaces of the suction port may be formed in an asymmetrical shape.

Furthermore, the suction port may be formed such that a circumferential inner side surface closer to the vane between both circumferential inner side surfaces is deeper with respect to a radial center line than a circumferential inner side surface of the suction port on an opposite side of the radial center line from the vane.

Furthermore, the suction portion may have a chamfered portion formed on at least one of edges in contact with an inner circumferential surface of the cylinder.

Furthermore, the suction port may be formed such that an inner circumferential end cross-sectional area is greater than an outer circumferential end cross-sectional area with respect to the cylinder.

Furthermore, the suction port may be formed such that an inner circumferential end cross-sectional area is equal to an outer circumferential end cross-sectional area with respect to the cylinder.

Furthermore, the suction port may include a first portion communicatively coupled with a suction pipe, in which at least one of both axial side surfaces of the cylinder is closed; and a second portion extended from the first portion and communicatively coupled with the compression chamber through an inner circumferential surface of the cylinder, in which both axial side surfaces of the cylinder are open, wherein a radial center line of the first portion and a radial center line of the second portion are formed on different lines.

Furthermore, a radial center line of the second portion may be disposed closer to the vane than a radial center line of the first portion.

In addition, in order to accomplish the objectives of the present disclosure, there is provided a rotary compressor, including a first cylinder that forms a first compression chamber, and formed with a first suction port communicatively coupled with the first compression chamber and formed with a first vane slot on one side of the first suction port; a first roller rotatably provided in the first compression chamber; a first vane inserted into the first vane slot and slidably coupled to the first cylinder, and brought into contact with an outer circumferential surface of the first roller; a second cylinder disposed on one axial side of the first cylinder to form a second compression chamber separated from the first compression chamber, and formed with a second suction port communicatively coupled with the second compression chamber, and formed with a second vane slot on one side of the second suction port; a second roller rotatably provided in the second compression chamber; a second vane inserted into the second vane slot and slidably coupled to the second cylinder, and brought into contact with an outer circumferential surface of the second roller; and an intermediate plate provided between the first cylinder and the second cylinder to divide between the first compression chamber and the second compression chamber, and formed with a suction passage connected to a suction pipe, the suction passage being communicatively coupled with the first suction port and the second suction port, wherein at least one of the first suction port and the second suction port is formed such that an inner circumferential surface of the cylinder and at least one surface brought into contact with the intermediate plate between both axial side surfaces of the cylinder are open to communicate with each other.

Furthermore, at least one of the first suction port and the second suction port may be formed in a slot shape such that both axial side surfaces thereof are open.

Furthermore, at least one of the first suction port and the second suction port may be formed in a slot shape as a whole from an outer circumferential end to an inner circumferential end of the cylinder.

Furthermore, at least one of the first suction port and the second suction port may include a non-slot portion formed to block at least one of both axial side surfaces of the cylinder; and a slot portion formed to be recessed in a slot shape by a predetermined depth from an inner circumferential surface of the cylinder and connected to the non-slot portion.

In the rotary compressor according to the present disclosure, an end of the suction port may be formed in a slot shape to reduce a circumferential length of the suction port in comparison with the same area of the suction port so as to move a compression start angle in a suction start angle direction, thereby lengthening compression period to suppress over-compression.

Furthermore, in the rotary compressor according to the present disclosure, the suction port may be formed in a slot shape to allow a partition wall portion between the suction port and the vane slot to have an elasticity, thereby suppressing a vane separating between the suction chamber and the discharge chamber from being excessively brought into close contact with a vane slot to suppress an input loss of a motor. In addition, it may be possible to suppress separation between the vane and the roller, thereby reducing compression loss according to refrigerant leakage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a rotary compressor according to the present disclosure will be described in detail with reference to an embodiment illustrated in the accompanying drawings.

Figure 1:
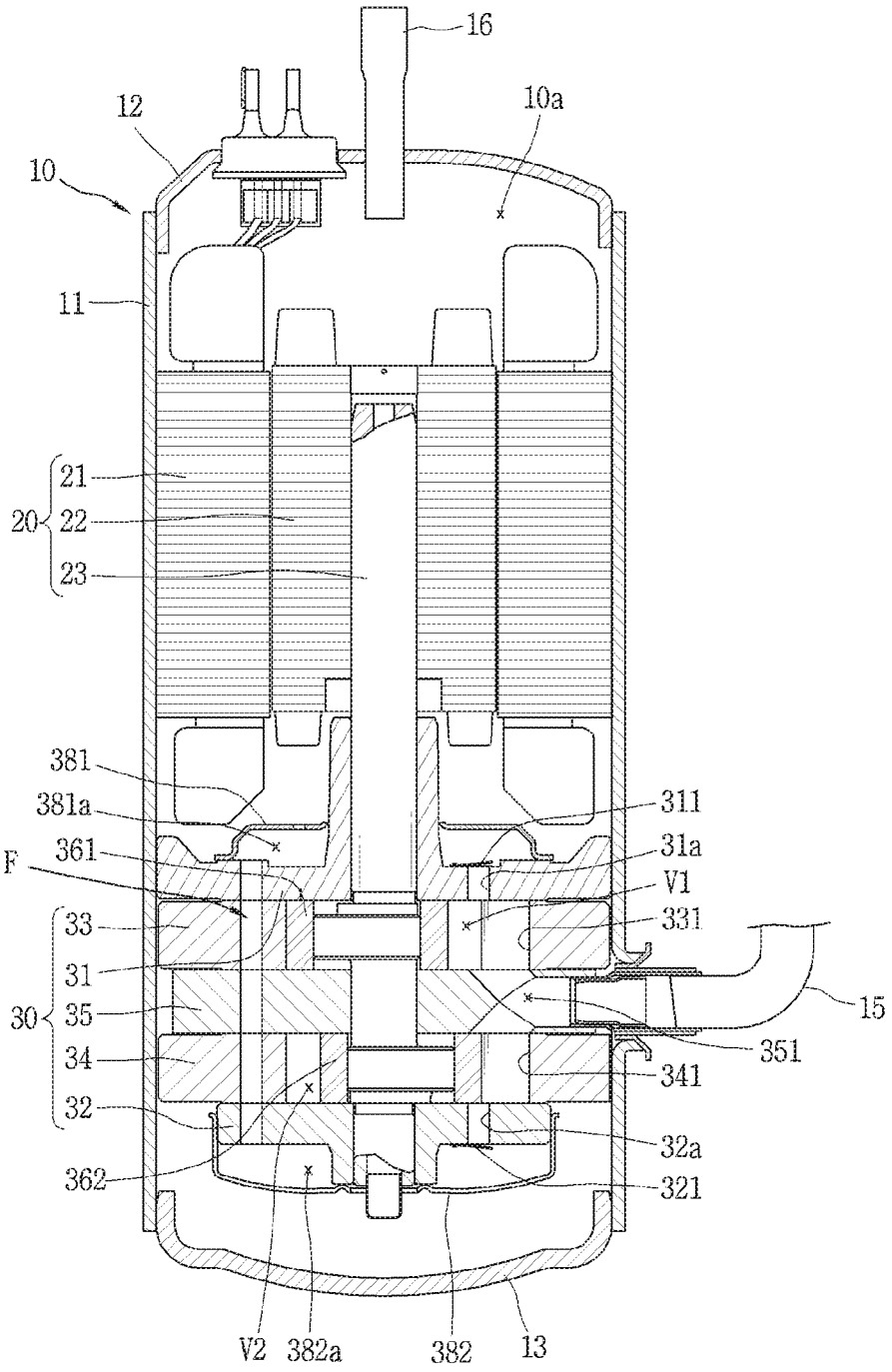
FIG. 1 is a longitudinal cross-sectional view showing a rotary compressor according to the present disclosure.
Figure 2:
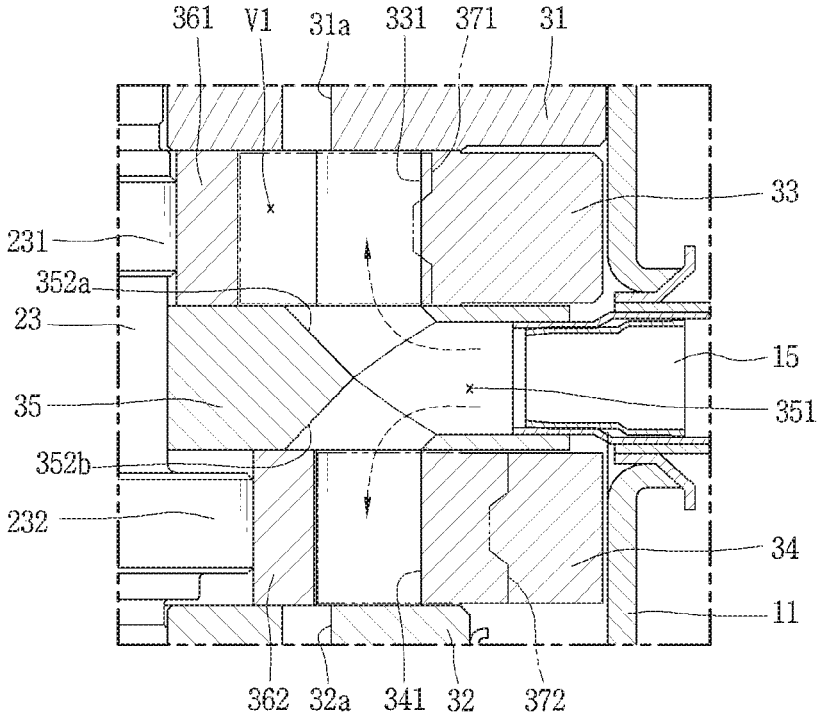
FIG. 2 is a longitudinal cross-sectional view showing part of a compression unit in the rotary compressor according to FIG. 1.
Figure 3:
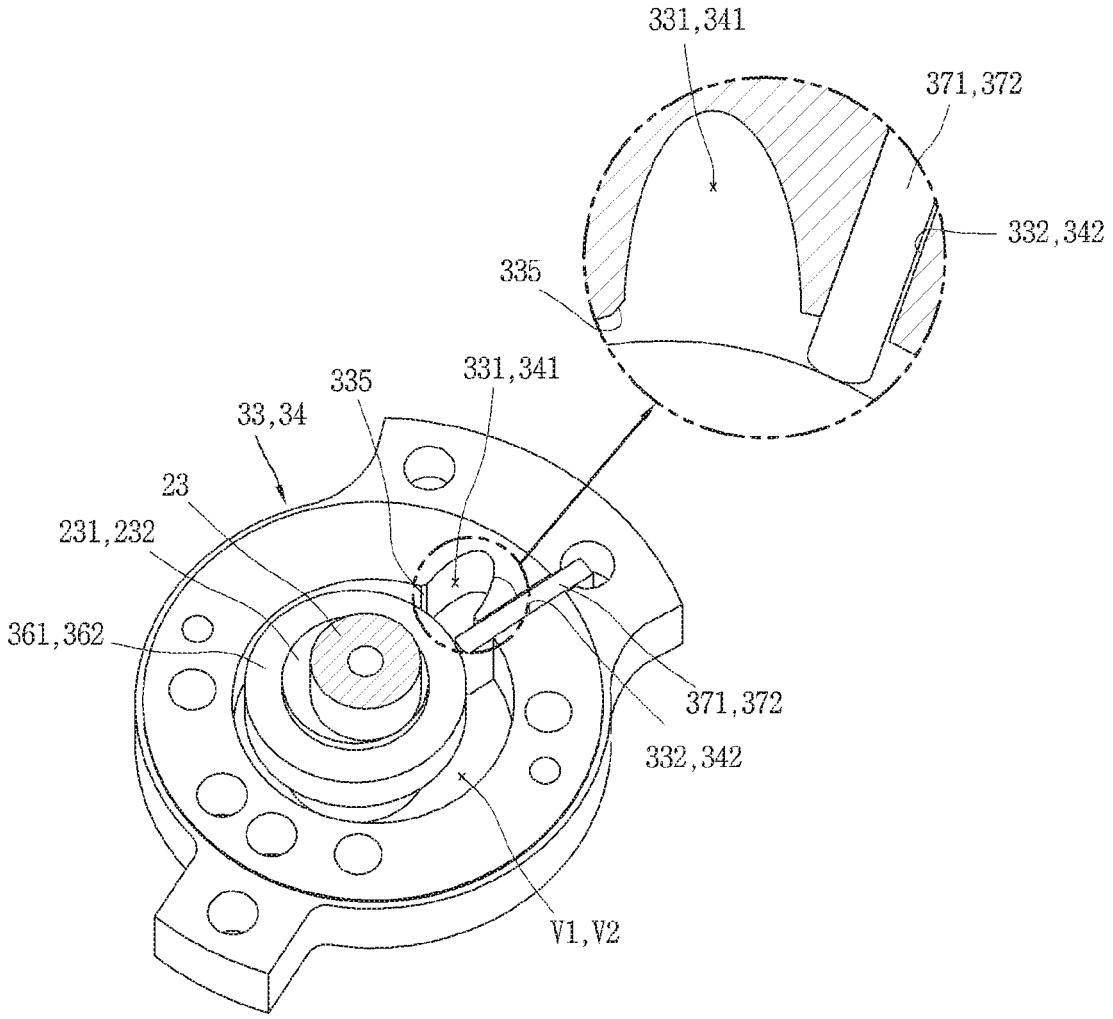
FIG. 3 is a perspective view with a portion shown as an enlarged cross-sectional view showing a first cylinder in the rotary compressor according to FIG. 1.
Figure 4:
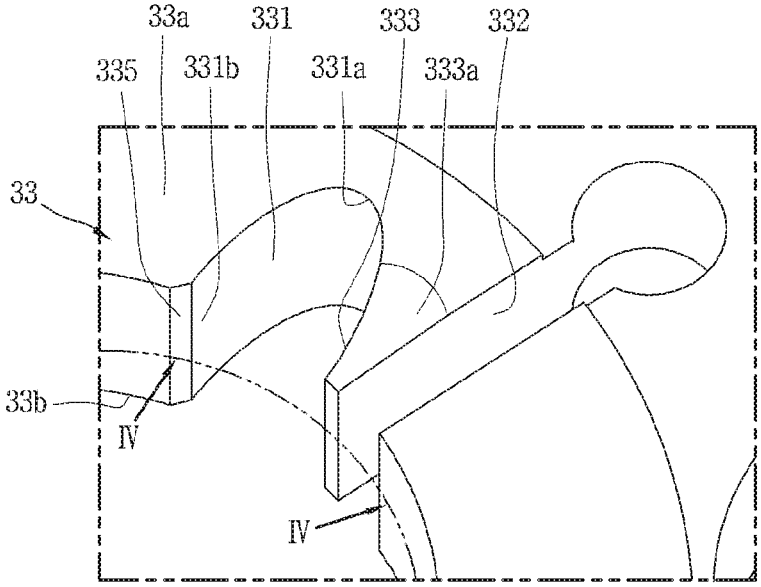
FIG. 4 is an exploded perspective view showing a vicinity of a first suction port in FIG. 3.
Figure 5:
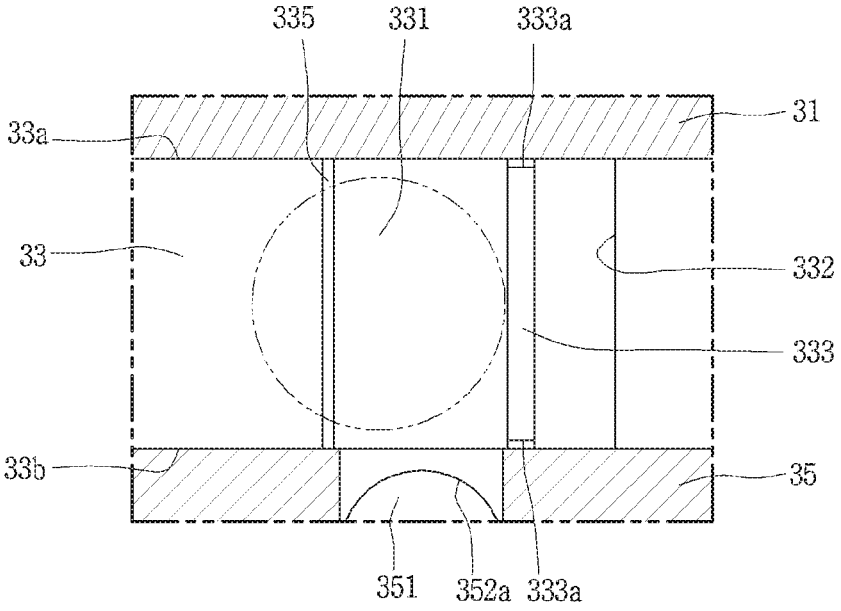
FIG. 5 is a cross-sectional view taken along line "IV-IV" in FIG. 4.

FIG. 1 is a longitudinal cross-sectional view showing a rotary compressor according to the present disclosure, FIG. 2 is a longitudinal cross-sectional view showing part of a compression unit in the rotary compressor according to FIG. 1, FIG. 3 is a longitudinal cross-sectional view showing a first cylinder in the rotary compressor according to FIG. 1, and FIG. 4 is an exploded perspective view showing a vicinity of a first suction port in FIG. 3, and FIG. 5 is a cross-sectional view taken along line "IV-IV" in FIG. 4.

Referring to FIG. 1, in the rotary compressor according to the present embodiment, an electric motor unit 20 is provided in an inner space of a casing 10, and a compression unit 30 for sucking and compressing refrigerant and then discharging the refrigerant into an inner space 10*a* of the casing is provided at a lower side of the electric motor unit 20. The electric motor unit 20 and the compression unit 30 are mechanically connected to each other by a rotation shaft 23.

The casing 10 includes a circular cylindrical housing 11 having both upper and lower open ends and an upper cap 12 and a lower cap 13 which cover the upper and lower ends of the circular cylindrical housing 11 to seal the inner space 10*a*.

A suction pipe 15 connected to an outlet side of an accumulator 40 is coupled to a lower half portion of the circular cylindrical housing 11, and a discharge pipe 16 connected to a discharge side refrigerant pipe at an inlet side of a condenser 2 may be coupled to the upper cap 12. The suction pipe 15 may be directly connected to a suction passage 351 of an intermediate plate 35 which will be described later through the circular cylindrical housing 11, and the discharge pipe 16 may be communicatively coupled with the inner space 10*a* of the casing through the upper cap 12. The suction passage of the intermediate plate and a suction port of a cylinder contained within cylindrical housing 11 and fluidly communicating with the suction passage will be described later.

For the electric motor unit 20, a stator 21 is press-fitted into and fixed to the casing 10, and a rotor 22 is rotatably inserted into the stator 21. A rotary shaft 23 is press-fitted and coupled to the center of the rotor 22.

For the compression unit 30, a main bearing 31 supporting the rotary shaft 23 is fixedly coupled to an inner circumferential surface of the casing 10, and a sub-bearing 32 supporting the rotation shaft 23 together with the main bearing 31 is provided at a lower side of the main bearing 31. A cylinder for forming a compression space together with the main bearing 31 and the sub-bearing 32 is provided between the main bearing 31 and the sub-bearing 32.

In various embodiments of this disclosure, only one cylinder may be provided in circular cylindrical housing 11 of casing 10. In various alternative embodiments a plurality of cylinders may be stacked in an axial direction within circular cylindrical housing 11 of casing 10. A case with one cylinder is called a single type, and a case with a plurality of cylinders is called a twin type. In the case of a single type, one compression space is formed in one cylinder, and in the case of a twin type, two cylinders typically form a first compression space and a second compression space with the intermediate plate therebetween. However, in some cases, two or more cylinders may form two or more compression spaces in the case of a twin type.

Furthermore, in the case of the single type, the cylinder is fastened and fixed to the main bearing 31 together with the sub-bearing 32 by bolts, and in the case of the twin type, for a plurality of cylinders 33, 34, an upper cylinder 33 is bolted to an upper surface of the intermediate plate 35 together with the main bearing 31 and a lower cylinder 34 is bolted to a lower surface of the intermediate plate 35 together with the sub-bearing 32 by interposing the intermediate plate 35 therebetween. Hereinafter, a twin rotary compressor having an intermediate plate will be described as a representative example.

For example, as shown in FIGS. 1 and 2, in the case of a twin rotary type, as described above, a plurality of cylinders are provided in an axial direction, and the main bearing 31 is provided on an upper surface of a cylinder (hereinafter, first cylinder) 33 located at an upper side of the plurality of cylinders to form a first compression space (V1), and the sub-bearing 32 is provided on a lower surface of a cylinder (hereinafter, second cylinder) 34 located at a lower side of the plurality of cylinders to form a second compression space (V2).

A first discharge port 31*a* for discharging refrigerant compressed in the first compression space 331 is formed in the main bearing 31, and a first discharge valve 311 for opening and closing the first discharge port 31*a* is provided at an end portion of the first discharge port 31*a*. A first discharge cover 381 having a first discharge space 381*a* is provided on an upper surface of the main bearing 31.

A second discharge port 32*a* for discharging refrigerant compressed in the second compression space 341 is formed in the sub-bearing 32, and a second discharge valve 321 for opening and closing the second discharge port 32*a* is provided at an end portion of the second discharge port 32*a*. A second discharge cover 382 having a second discharge space 382*a* is provided on a lower surface of the sub-bearing 32.

Furthermore, an intermediate plate 35 is provided between the first cylinder 33 and the second cylinder 34, and the first compression space (V1) is formed together with the main bearing 31 in the first cylinder 33, and the second compression space (V2) is formed together with the sub-bearing 32 in the second cylinder 34 by interposing the intermediate plate 35 therebetween.

FIG. 3 is a perspective view showing a first cylinder and a second cylinder according to the present embodiment, with an exploded cross-sectional view showing a portion with a suction port and a vane slot. FIG. 3 shows the first cylinder c and the second cylinder together, and a first rolling piston and a second rolling piston, which will be described later. The first rolling piston and the second rolling piston may be combined to have a rotation angle difference of 180 degrees. However, in FIG. 3, the first rolling piston is illustrated at the same position as the second rolling piston for the sake of convenience of explanation.

As shown in FIG. 3, the first cylinder 33 and the second cylinder 34 may be respectively formed with a first suction port 331 and a second suction port 341 for communicating a suction passage 351 which will be described later with the first compression space (V1) and the second compression space (V2), respectively. Furthermore, a first vane slot 332 through which a first vane 371 is slidably inserted on one side of the first suction port 331 and a second vane slot 342 into which a second vane 372 is slidably inserted on one side of the second suction port 341 may be formed in the first cylinder 33 and second cylinder 34, respectively.

A first rolling piston 361 and a second rolling piston 362 are rotatably coupled to the first compression space (V1) and the second compression space (V2) with respect to the first eccentric portion 231 and the second eccentric portion 232 of the rotation shaft 23, respectively. The first rolling piston 361 is sealed in contact with the main bearing 31 by the intermediate plate 35 and the second rolling piston 362 is sealed in contact with the sub-bearing 32 by the intermediate plate 35 in an axial direction, respectively.

The intermediate plate 35 may be provided with a suction passage 351 fluidly coupled to the suction pipe 15. The suction passage 351 may be formed in a radial direction to a predetermined depth on an outer circumferential surface of the intermediate plate 35, and a first end of the first suction port 331 and the second suction port 341 may be formed to communicate with an upper half portion and a lower half portion of the suction passage 351 through a first communication hole 352*a* and a second communication hole 352*b*, respectively.

Furthermore, at least one of the first suction port 331 and the second suction port 341 has a second end opposite to the first end, which is communicatively coupled with an inner circumferential surface of the relevant cylinder and recessed to a predetermined depth on an inner circumferential surface of the cylinder. Hereinafter, the first suction port will be described as a representative example. Therefore, the second suction port may be formed in the same manner as the first suction port, and in some cases, the second suction port may be formed in a hole shape through the cylinder in the same shape at both ends thereof. Of course, as described above, for the second suction port, the second end may be formed to be recessed, and the first suction port may be formed in a hole shape as a whole.

As shown in FIGS. 4 and 5, for the first suction port 331, a second end 331*b* of the suction port that forms an outlet end in contact with an inner circumferential surface of the first cylinder 33 may be recessed in a radial direction to form a slot shape. Accordingly, the first suction port 331 has a first end 331*a* forming an inlet end and a second end 331*b* forming an outlet end, and at least the second end 331*b* of the first suction port 331 may be formed in a slot shape passing through both the upper surface 33*a* and the lower surface 33*b* of the first cylinder 33. As a result, a circumferential length of the first suction port may be reduced to a minimum as compared with the same cross-sectional area, and accordingly, the suction completion time may be greatly shortened.

Here, for the first suction port 331, the suction port as a whole, extending from the foregoing second end 331*b* all the way to the first end 331*a* which is an inlet end may be formed in a slot shape, and as a result, the entire length of the first suction port 331 as a whole may be formed in a slot shape extending between the upper surface 33*a* and the lower surface 33*b* of the first cylinder 33.

In this case, as shown in FIG. 5, the first suction port 331 may be formed in a dome shape such as a so-called semi-circular or semi-elliptical shape in planar projection to gradually enlarge the cross-sectional area from the first end 331*a* to the second end 331*b* of the first suction port 331, which is in contact with an inner circumferential surface of the first cylinder 33. In this case, the first suction port 331 may be formed to correspond to or accommodate an inner circumferential surface of the communication hole 352*a* in consideration of the shape of the communication hole 352*a* passing from the suction passage 351 toward the first cylinder in an inclined manner. For reference, a circle shown by a dotted line in FIG. 5 illustrates the first suction port in the related art.

However, in some cases, the first suction port 331 may have a rectangular cross-sectional shape from the first end 331*a* to the second end 331*b* in a planar projection. In this case, the manufacturing of the first suction port 331 may be easily carried out.

Furthermore, the first suction port 331 may be preferably formed with a chamfered portion 335 on at least one of the edges of the first cylinder 33 in contact with an inner circumferential surface of the first cylinder 33 to suppress the wear of the first rolling piston 361. In this case, the chamfered portion 335 may be preferably formed at an edge located on the farther side with respect to an edge located in an opposite direction to a movement direction of the first rolling piston 361, that is, with respect to the first vane slot 332.

The foregoing twin rotary compressor according to this embodiment operates as follows.

When power is applied to the stator 21, the rotor 22 and the rotation shaft 23 rotate inside the stator 21 while the first rolling piston 361 and the second rolling piston 362 perform an orbiting motion, and allow refrigerant to flow into each of the compression spaces (V1, V2) of the first cylinder 33 and the second cylinder 34 while a suction chamber volume of each of the compression spaces (V1, V2) is varied in accordance with an orbiting motion of the first and second rolling pistons 361, 362.

The refrigerant is discharged to the discharge spaces 381*a*, 382*a* of the first discharge cover 381 and the second discharge cover 382, respectively, through the first discharge port 31*a* of the main bearing 31 and the second discharge port 32*a* of the sub-bearing 32 while a compression load in the first compression space (V1) and the second compression space (V2) is generated by the first rolling piston 361 and the first vane 371 and by the second rolling piston 362 and the second vane 372.

Then, while refrigerant discharged to the first discharge cover 381 is directly discharged to the inner space 10*a* of the casing 10, refrigerant discharged to the second discharge cover 382 is moved to the discharge space 381*a* of the first discharge cover 381 through a refrigerant passage (F) that sequentially passes through the sub-bearing 32, the second cylinder 34, the intermediate plate 35, the first cylinder 33, and the main bearing 31. A series of processes in which the refrigerant is discharged to the inner space 10*a* of the casing 10 together with the refrigerant discharged from the first compression space (V1), and circulated to the cooling cycle are repeated.

Furthermore, refrigerant that has passed through the cooling cycle flows into the suction passage 351 of the intermediate plate 35 through the suction pipe 15, and the refrigerant is distributed to the first suction port 331 and the second suction port 341, respectively, through the communication hole 352*a*, 352*b* communicating with the suction passage 351 and sucked into the first compression space (V1) and the second compression space (V2).

Here, refrigerant being sucked into the first compression space (V1) through the first suction port (refrigerant at the second suction port is substantially the same as that at the first suction port, and thus a description thereof is essentially the same as the description of the first suction port) may be uniformly distributed over the entire area between the upper surface 33*a* and the lower surface 33*b* of the first cylinder 33 and sucked into the first compression space (V1) since the entire portion of the first suction port 331 is formed in a slot shape.

Figure 6A:
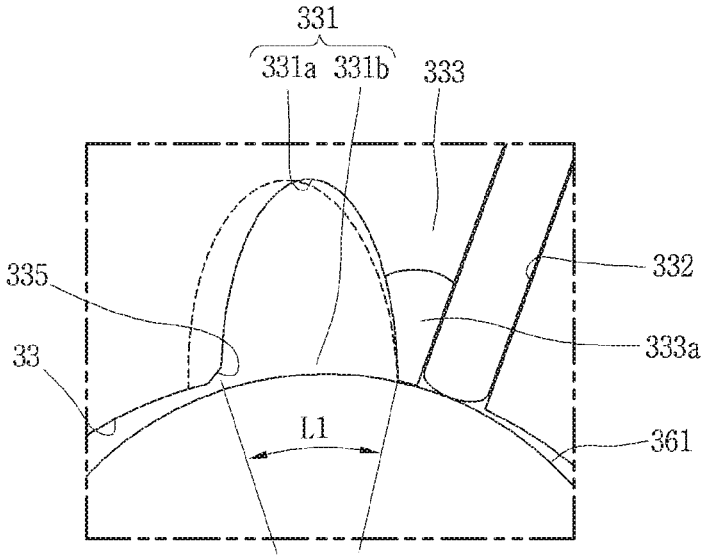
FIGS. 6A and 6B are schematic views showing the effect on the first suction port of the compression unit according to FIG. 3.

Accordingly, as shown in FIG. 6A, as the second end 331*b* of the first suction port 331 according to the present embodiment is formed entirely along the height direction of the first cylinder 33, a circumferential length (L1) of the first suction port 331 may be minimized as compared with a case where an inner circumferential surface of the cylinder 33 is formed with a hole or a groove shape having a closed top side (indicated by a dotted line). Through this, the suction completion time of the refrigerant and the resultant compression start time are advanced, and thus the compression period in the relevant compression space is lengthened, thereby suppressing over-compression to improve compression efficiency.

Figure 6B:
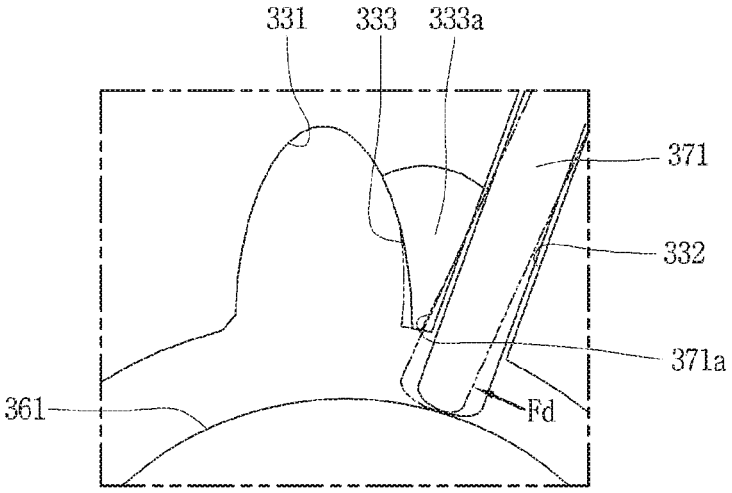

Moreover, as shown in FIG. 6B, the first suction port 331 (also the second suction port) is formed in a slot shape, and thus a partition wall portion 333 between the first suction port 331 and the first vane slot 332 becomes a cantilever shape, thereby performing the role of a type of cushioning portion having elasticity. Then, c even when the first vane 371 receives the discharge pressure (Fd) in a circumferential direction toward the first suction port 331, it may be possible to suppress a suction side surface 371*a* of the first vane 371 from being excessively brought into close contact with an inner surface of the first vane slot 332 Accordingly, a friction loss with respect to the first vane may be reduced to prevent the first vane from being separated from an outer circumferential surface of the first rolling piston, thereby suppressing compression loss due to refrigerant leakage.

In this case, as shown in FIG. 4, a spacing portion 333*a* may be formed in a stepped manner to be smoothly slid with respect to the main bearing 31 and the intermediate plate 35 in contact with the partition wall portion 333 on a upper surface or a lower surface of the partition wall portion 333 serving as a buffering portion. Through this, when the partition wall portion is deformed, friction against a surface in contact with the partition wall portion may be reduced to increase a buffering force while the partition wall portion is more rapidly deformed.

Though not shown in the drawing, a spacer portion may be further formed on a lower surface of the main bearing 31 in contact with the partition 333 or on an upper surface of the intermediate plate 35 or formed on either one of the partition wall portion 333 and the main bearing 31 and the partition wall portion 333 and the intermediate plate 35.

Meanwhile, another embodiment of the first suction port according to the present disclosure will be described as follows.

In the above-described embodiment, the entire first suction port is formed in a slot shape. But in the present embodiment, part of the first suction port 331 is formed in a slot shape and the remaining portion thereof is formed in a hole or groove shape passing through the first cylinder 33.

Figure 7A:
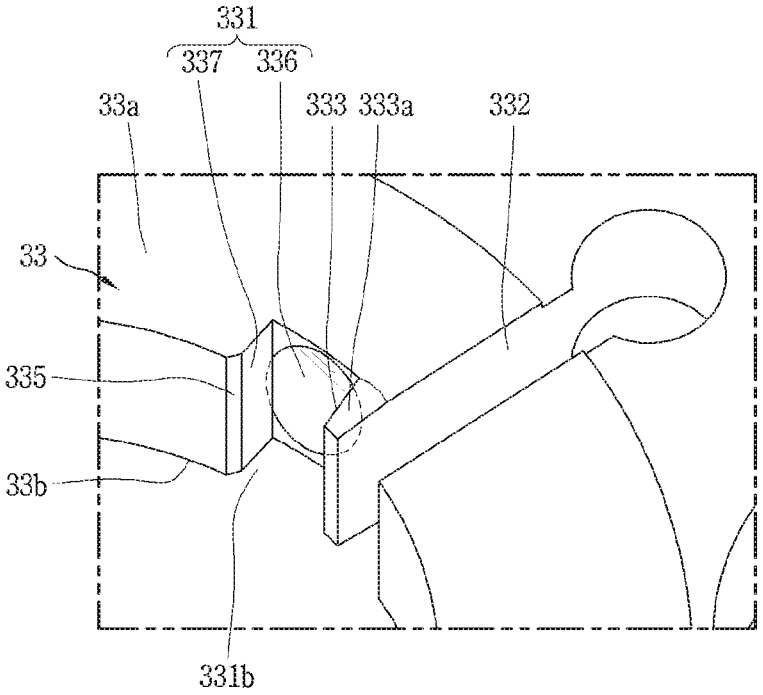
FIGS. 7A and 7B are a perspective view and a plan view showing another embodiment of a suction port according to the present disclosure.
Figure 7B:
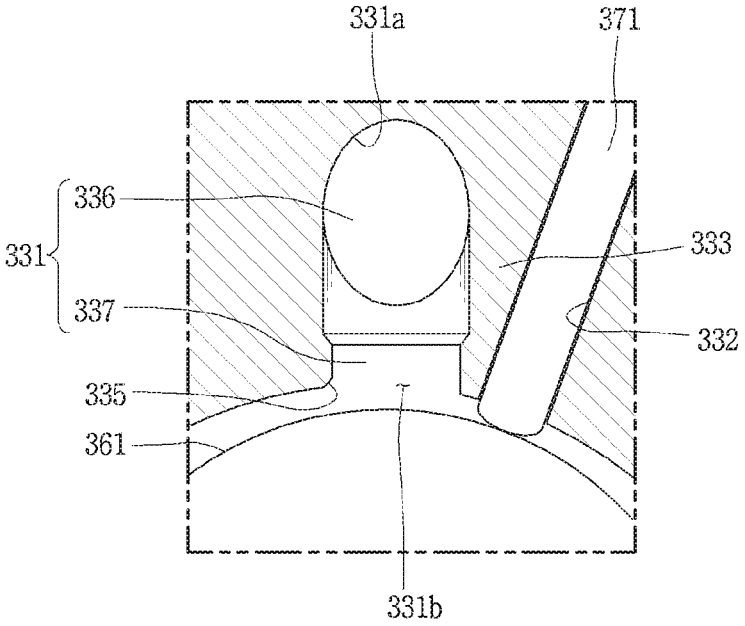

For example, as shown in FIGS. 7A and 7B, the first suction port 331 is formed with a non-slot portion 336 to block at least one of axial side surfaces 33*a*, 33*b* of the first cylinder 33, and a slot portion 337 connected to the non-slot portion 336 may be recessed to a predetermined depth from an inner circumferential surface of the first cylinder 33 toward the non-slot portion 336 to have a slot shape.

Here, the non-slot portion 336 may be connected to the first communication hole 352*a* of the intermediate plate 35 to have a "⌈"-shaped hole shape, or formed in a groove shape inclined from a lower surface 33*b* of the first cylinder 33 in contact with an upper surface of the intermediate plate 35 toward the inner circumferential surface.

Furthermore, the slot portion 337 is recessed to a predetermined depth from an inner circumferential surface of the first cylinder 33 toward an outer circumferential surface thereof (i.e., non-slot portion), and formed in a slot shape having both open axial side surfaces of the first cylinder 33.

The basic configuration and operation effects of the suction port according to the present embodiment as described above are similar to those of the above-described embodiment. However, according to the present embodiment, an upper surface of the first suction port 331 may be formed in a closed shape, and thus it may be possible to secure a cylinder strength in a portion constituting the first suction port as compared with the above-described embodiment in which the entire first suction port has a slot shape. In addition, the vicinity of the second end 331*b* constituting an outlet end of the first suction port 331 is formed to be recessed from the inner circumferential surface, and thus a cross-sectional area of an outlet end of the suction port may be secured to be larger while the circumferential length is smaller as compared with the hole as described in the foregoing embodiment, thereby advancing the suction completion time to increase compression efficiency.

Moreover, the partition wall portion 333 forming the slot portion 338 may serve as a cushioning portion to suppress the first vane 371 from being excessively brought into close contact with the first vane slot 332 by a discharge pressure, thereby enhancing compression performance as compared with a case where the first suction port 331 is formed in a hole shape.

Refrigerant sucked into the first compression space (V1) through the first suction port 331 passes through the slot portion 337 and through the non-slot portion 336 constituting the first suction port 331. At this time, as the non-slot portion 336 is formed in a hole shape or a groove shape having a closed top side, refrigerant is not directly in contact with the main bearing 31, and therefore receives less heat from the main bearing 31. Accordingly, it may be possible to suppress refrigerant being sucked into the first compression space (V1) from increasing the specific volume due to overheating, thereby reducing the suction loss of the refrigerant.

Another embodiment of the first suction port according to the present disclosure will be described as follows.

In the above-described embodiments, the first suction port is formed to have the same symmetrical shape at both sides with respect to a radial center line in a planar projection (axial projection), but in this embodiment, the first suction port 331 is formed to have an asymmetric shape at both sides.

For example, when the first suction port 331 is formed in a symmetrical shape, it may be advantageous in that the first suction port 331 can be easily manufactured. However, in this case, as the cross sectional areas of both sides thereof is the same with respect to a radial center line (CL), refrigerant is substantially uniformly distributed throughout the entire area of the first suction port 331, and thus as the refrigerant is sucked in, the suction stroke becomes longer and the suction completion time may be relatively delayed.

Figure 8A:
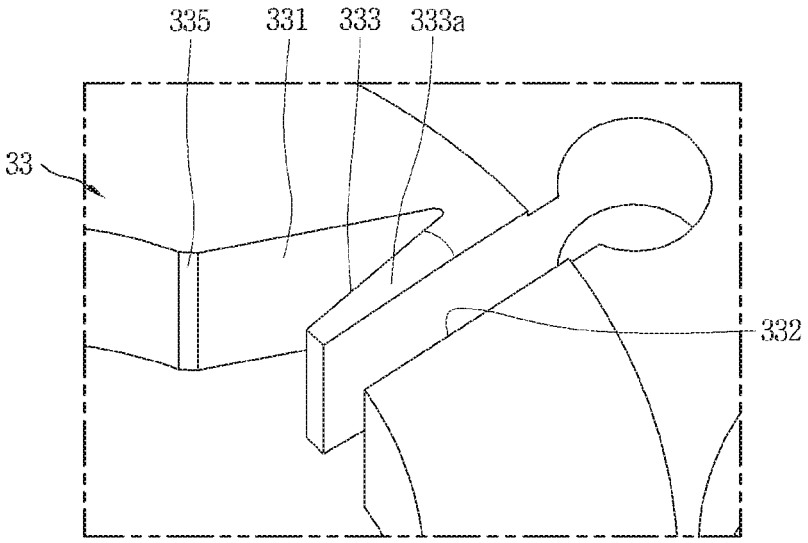
FIGS. 8A and 8B are a perspective view and a plan view showing still another embodiment of a suction port according to the present disclosure.
Figure 8B:
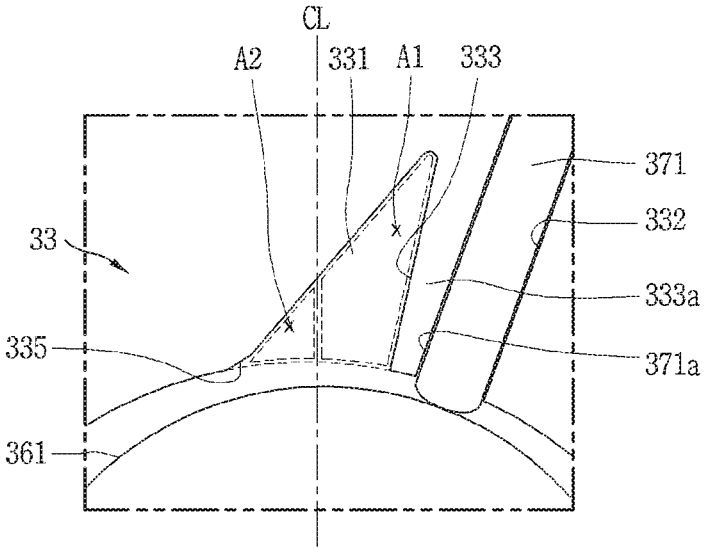

In contrast, in the embodiment shown in FIGS. 8A and 8B, when the first suction port 331 has an asymmetric shape, that is, when the suction port 331 has a cross sectional area (A1) closer to the first vane slot 332 with respect to the radial center line (CL) that is larger than a cross sectional area (A2) opposite thereto, more refrigerant may be guided to a side where suction is started. Accordingly, the suction completion time may be further shortened as compared with the symmetrical shape.

Furthermore, when the first suction port 331 is asymmetrical and the cross-sectional area (A1) closer to the first vane slot 332 is relatively larger than the cross-sectional area (A2) opposite thereto, a radial length of the partition wall portion 333 located between the first suction port 331 and the first vane slot 332 may be formed to be larger. Accordingly, it may be possible to more effectively prevent the suction side surface 371*a* of the first vane 371 from being excessively brought into close contact with an inner surface of the first vane slot 332. Accordingly, a friction loss with respect to the first vane may be reduced to prevent the first vane from being separated from an outer circumferential surface of the first rolling piston, thereby suppressing compression loss due to refrigerant leakage.

As described above, the second suction port is formed substantially the same as the first suction port, and has the same operational effect. Therefore, the description of the second suction port is essentially the same as the description of the first suction port.

Although the above-described embodiments relate to a twin rotation compressor, the above-described slot-shaped suction port may be applied in the same manner to a single rotary compressor.

Figure 9:
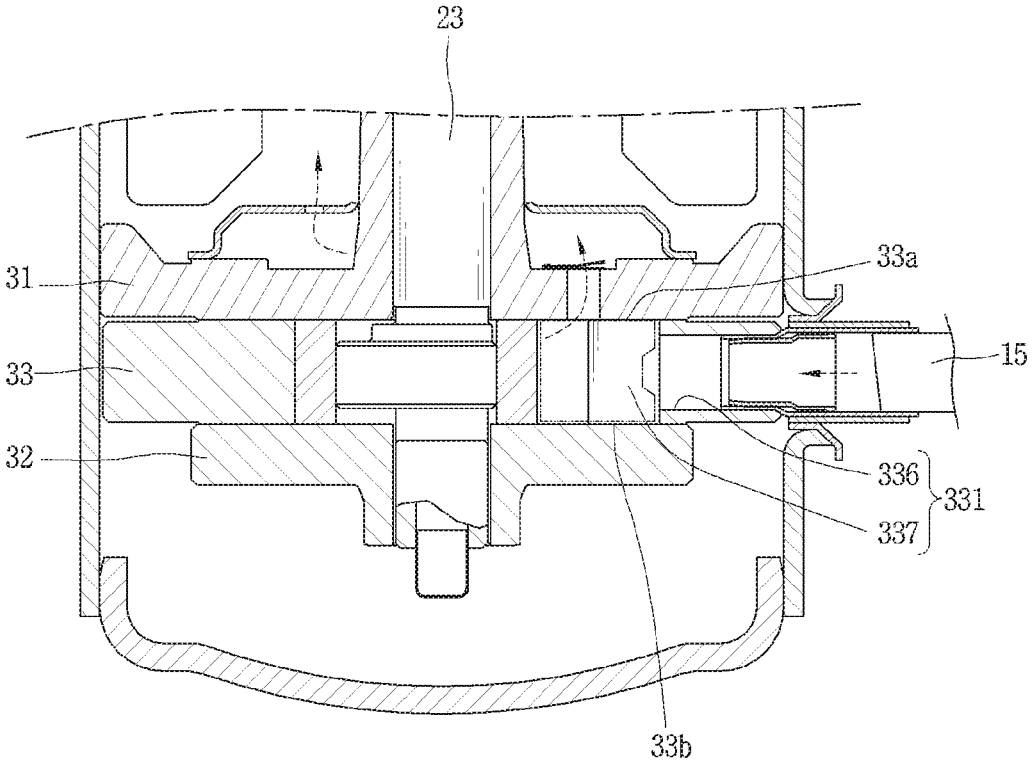
FIG. 9 is a longitudinal cross-sectional view showing a compression unit of a single rotary compressor according to the present disclosure.

For example, as shown in FIG. 9, in the case of a single rotary compressor, the suction port 331 may be formed to pass from an outer circumferential surface to an inner circumferential surface of the cylinder 33.

In this case, the suction port 331 may be formed as a non-slot portion 336 such as a hole from an outer circumferential surface toward an inner circumferential surface of the cylinder 33 up to a substantially intermediate depth while the slot portion 337 is formed in a slot shape in which the upper surface 33*a* and the lower surface 33*b* of the cylinder 33 are open from the intermediate depth in a radial direction to an inner circumferential surface of the cylinder 33.

The basic structure and operational effects of the foregoing slot-shaped suction port may be substantially the same as those of the embodiment in which the first suction port (and/or the second suction port) 331, 341 is or are open between the upper surface 33*a* and the lower surface 33*b* of the cylinder 33 to have a slot shape as a whole in the foregoing twin rotary compressor. Therefore, the detailed description thereof is essentially the same as the description of the foregoing embodiments.

Meanwhile, in the case of a twin rotary compressor in the foregoing embodiments, when the suction pipe 15 is connected to the first cylinder 33 and the second cylinder 34, respectively, the suction port may be formed in the same manner as that of a single rotary compressor having one cylinder.

In addition, in the case of a single rotary compressor in the foregoing embodiments, when the suction pipe is connected to the main bearing or the sub-bearing, the suction port may be formed in the same manner as that of a twin rotary compressor having a plurality of cylinders.

What is claimed is:

1. A rotary compressor, comprising: a cylinder having an annular shape; at least two plate members provided on upper and lower axial side surfaces of the cylinder, respectively, and forming a compression chamber together with the cylinder; a rolling piston provided inside the compression chamber, the rolling piston being coupled to a rotation shaft; and a vane slidably disposed in a vane slot formed in the cylinder such that contact between the vane and an outer circumferential surface of the rolling piston divides the compression chamber into a suction chamber and a discharge chamber, wherein the cylinder comprises a suction port configured for guiding fluid to the compression chamber at one circumferential side of the vane slot, and the suction port is recessed in a radial direction such that at least an inner circumferential end of the suction port located at an inner circumferential surface of the cylinder forms a slot shape extending between the upper and lower axial side surfaces of the cylinder, wherein the suction port has an asymmetric shape, the suction port having a cross sectional area closer to the vane slot with respect to a radial center line of the suction port that is larger than a cross sectional area disposed on an opposite side of the radial center line from the vane.

2. The rotary compressor of claim 1, wherein the suction port is formed in the slot shape from an outer circumferential end to the inner circumferential end located at the inner circumferential surface of the cylinder.

3. The rotary compressor of claim 1, wherein the suction port comprises a chamfered portion formed on at least one edge of the suction port in contact with the inner circumferential surface of the cylinder.

4. The rotary compressor of claim 1, wherein the suction port is formed such that an inner circumferential end cross-sectional area is greater than an outer circumferential end cross-sectional area with respect to the cylinder.

5. A rotary compressor, comprising: a first cylinder, comprising: a first compression chamber, a first suction port communicatively coupled with the first compression chamber, and a first vane slot on one side of the first suction port; a first roller rotatably supported in the first compression chamber; a first vane slidably disposed in the first vane slot, and contacting an outer circumferential surface of the first roller; a second cylinder disposed on one axial side of the first cylinder, and forming a second compression chamber separated from the first compression chamber, the second cylinder comprising: a second suction port communicatively coupled with the second compression chamber, and a second vane slot on one side of the second suction port; a second roller rotatably supported in the second compression chamber; a second vane slidably disposed in the second vane slot, and contacting an outer circumferential surface of the second roller; and an intermediate plate disposed between the first cylinder and the second cylinder, separating the first compression chamber and the second compression chamber, and formed with a suction passage configured for connection to a suction pipe, the suction passage being communicatively coupled with the first suction port and the second suction port, wherein at least one of the first suction port or the second suction port fluidly connects an inner circumferential surface of the respective first or second cylinder and at least one axial side surface of the respective first or second cylinder in contact with the intermediate plate, wherein a first partition wall portion is formed between the first suction port and the first vane slot and a second partition wall portion is formed between the second suction port and the second vane, wherein the first suction port has an asymmetric shape, the first suction port having a cross sectional area closer to the first vane slot with respect to a radial center line of the first suction port that is larger than a cross sectional area disposed on an opposite side of the radial center line from the first vane.

6. The rotary compressor of claim 5, wherein at least one of the first suction port or the second suction port is formed in a slot shape extending between opposite axial side surfaces of the respective first or second cylinder such that both of the axial side surfaces thereof are open.

7. The rotary compressor of claim 5, wherein at least one of the first suction port or the second suction port is formed in a slot shape extending from an outer circumferential surface to the inner circumferential surface of the respective first or second cylinder.

* * * * *